US010190285B2

(12) United States Patent
Mizutani

(10) Patent No.: US 10,190,285 B2
(45) Date of Patent: Jan. 29, 2019

(54) EXCAVATING APPARATUS, EXCAVATION BLADE PLATE AND EXCAVATING METHOD

(71) Applicant: KOBELCO CONSTRUCTION MACHINERY CO., LTD., Horishima-shi (JP)

(72) Inventor: Motohiko Mizutani, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/722,737

(22) Filed: Oct. 2, 2017

(65) Prior Publication Data

US 2018/0094402 A1 Apr. 5, 2018

(30) Foreign Application Priority Data

Oct. 3, 2016 (JP) ..... 2016-195949

(51) Int. Cl.
*E02F 5/06* (2006.01)
*E02F 5/14* (2006.01)

(52) U.S. Cl.
CPC . *E02F 5/06* (2013.01); *E02F 5/14* (2013.01)

(58) Field of Classification Search
CPC .... E02D 5/18; E02D 17/13; E02F 3/08; E02F 3/086; E02F 3/088; E02F 3/085; E02F 3/10; E02F 3/142; E02F 3/145; E02F 5/06; E02F 5/12; E02F 5/14
USPC ..... 37/195, 352, 355, 462, 465; 299/34.01, 299/76
See application file for complete search history.

(56) References Cited

U.S. PATENT DOCUMENTS 4,483,084 A 11/1984 Caldwell et al.
6,354,026 B1 * 3/2002 Trevisani ..... E02D 17/13 37/352
7,010,873 B2 * 3/2006 Kinoshita ..... E02F 5/06 37/352
8,079,163 B2 * 12/2011 Shreider ..... E02D 17/13 37/142.5

(Continued)

FOREIGN PATENT DOCUMENTS

JP 9-3965 1/1997
JP 9-296441 11/1997

(Continued)

*Primary Examiner* — Robert E Pezzuto
(74) *Attorney, Agent, or Firm* — Oblon, McClelland, Maier & Neustadt, L.L.P.

(57) ABSTRACT

Provided are an excavating apparatus, an excavation blade plate and an excavating method which are capable of reducing a shear force to be applied to a fastening member fixedly fastening the excavation blade plate and a chain together. The excavating apparatus comprises a cutter post, a chain, a plurality of cutter bit plates, and a shoe bolt S1. The chain 11 is formed by mutually coupling a plurality of pairs of links arranged along a circulating movement direction thereof Each of the cutter bit plates includes: a support-target surface supported by a supporting surface of the chain; and a central convex portion formed to protrude with respect to the support-target surface and inserted in a space between the pair of links, wherein the central convex portion is in surface contact with inner side surfaces of the pair of links along the circulating movement direction.

8 Claims, 14 Drawing Sheets

(56) References Cited

U.S. PATENT DOCUMENTS

| | | | | |
|---|---|---|---|---|
| 8,209,888 | B2 * | 7/2012 | Lanser | E02F 3/10 299/34.01 |
| 8,966,790 | B2 * | 3/2015 | van de Coterlet | E02F 3/10 37/352 |
| 2009/0260264 | A1 * | 10/2009 | Cooper | E02D 17/13 37/195 |
| 2013/0192097 | A1 | 8/2013 | van de Coterlet | |

FOREIGN PATENT DOCUMENTS

| | | |
|---|---|---|
| JP | 11-81368 | 3/1999 |
| JP | 11-81369 | 3/1999 |
| JP | 2002-327450 | 11/2002 |
| JP | 2003-74084 | 3/2003 |
| JP | 2003-301477 | 10/2003 |
| JP | 2005-188262 | 7/2005 |
| JP | 2007-56664 | 3/2007 |

* cited by examiner

EXCAVATING APPARATUS, EXCAVATION BLADE PLATE AND EXCAVATING METHOD

TECHNICAL FIELD

The present invention relates to an excavating apparatus, an excavation blade plate and an excavating method for use in forming a continuous wall, such as a soil-cement wall for water cut-off or substruction, below a ground surface.

BACKGROUND

A conventional excavating apparatus for excavating a ground to form a continuous trench below a ground surface comprises a lower traveling body equipped with a crawler for traveling on the ground, an upper slewing body mounted on the under traveling body, and a portal frame provided in the upper slewing body. This portal frame is provided with a pair of traverse cylinders arranged one-above-the-other, and a leader. The pair of traverse cylinders are operable to slidingly move the leader in a traverse direction parallel to the ground surface. The excavating apparatus further comprises a cutter post and a chain-type cutter. The cutter post is suspended from the leader, and the chain-type cutter is configured to be circulatingly moved in an upward-downward direction while being guided by the cutter post. The chain-type cutter comprises an endless chain configured to be circulatingly driven, and a plurality of bit plates arranged on the endless chain on the side of an outer periphery thereof, at intervals along a circulating movement direction of the endless chain. On each of the bit plates, a plurality of excavation bits is arranged. By moving the cutter post below the ground surface in the traverse direction while circulatingly moving the chain-type cutters, a trench is excavated in a forward movement direction of the cutter post.

JP 2007-56664A discloses an excavating apparatus comprising a flat-shaped T-slotted plate holder attached to bit plates (excavating/agitating vanes) and a base plate attached to a endless chain. In this excavating apparatus, the plate holders and the base plates are fitted together, and, in this state, the bit plates and the endless chain are fixed together by a bolt and a nut.

In the technique described in JP 2007-56664A, the plate holder and the base plate lie in a connection region between each of the bit plates and the endless chain, so that the weight of a chain-type cutter is increased. Thus, a load to be imposed on the chain during circulating movement becomes larger, leading to a problem that damage of the chain is likely to occur. Further, due to variations in shape tolerance of the plate holder and the base plate, or depending on a fastening state of the bolt disposed across the plate holder and the base plate, a relative position of a plurality of excavation bits is likely to change, leading to a problem that an excavation plane becomes unstable. Moreover, the set of the plate holder and the base plate lie between the bolt and the nut, so that, due to reaction forces applied to the bit plate during excavation, a strong shear force is applied to the bolt, leading to a problem that loosening or disengagement of the bolt occurs.

SUMMARY

The present invention has been made in view of the above problem, and an object thereof is to provide an excavating apparatus, an excavation blade plate and an excavating method capable of reducing a shear force to be applied to a fastening member fixedly fastening the excavation blade plate and a chain together.

According to a first aspect of the present invention, there is provided an excavating apparatus for forming a continuous trench below a ground surface. The excavating apparatus comprises: an apparatus body disposed on the ground surface; a support member suspended from the apparatus body and disposed below the ground surface; an endless-shaped chain supported by the support member in such a manner as to be movable on an outer periphery of the support member in a given circulating movement plane in a given circulating movement direction; a plurality of excavation blade plates fixed to an outer peripheral surface of the chain at intervals along the circulating movement direction of the chain, wherein each of the excavation blade plates including: a plate body extending longer than the chain in a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, and wherein the excavation blade plates are circulatingly movable integrally together with the chain to thereby excavate the ground; a plurality of fastening members fastening the chain and the excavation blade plates together in a direction parallel to the circulating movement plane and orthogonal to the width direction, in such a manner that the outer peripheral surface of the chain and the reverse surface of the plate body come into press contact with each other; a chain drive section which circulatingly moves the chain in the circulating movement direction; and a support member drive section which moves the support member along a given forward movement direction. The chain includes: a pair of strip members each formed in an endless shape and disposed with a distance therebetween in the width direction, wherein each of the pair of strip members has the outer peripheral surface; and a coupling member coupling the pair of strip members together in such a manner as to enable the distance between the pair of strip members to be kept constant. Each of the excavation blade plates includes an inward-side protruding portion formed to protrude from the reverse surface of the plate body and inserted into a space between the pair of strip members, wherein the inward-side protruding portion has a pair of outer side surfaces each being in surface contact with a respective one of inner side surfaces of the pair of strip members extending in the circulating movement direction.

According to a second aspect of the present invention, there is provided an excavation blade plate which is fixed to an outer peripheral surface of an endless-shaped chain supported by a given support member in such a manner as to be movable on an outer periphery of the support member in a given circulating movement plane in a given circulating movement direction, wherein the chain includes a pair of strip members each formed in an endless shape and disposed with a distance therebetween in a given width direction, and a coupling member coupling the pair of strip members together in such a manner as to enable the distance between the pair of strip members to be kept constant. The excavation blade plate comprises: a plate body extending longer than the chain in the width direction of the chain orthogonal to each of the circulating movement plane of the chain and the circulating movement direction of the chain, and having an obverse surface and a reverse surface; a plurality of excavation blades arranged on the obverse surface of the plate body at least at opposite ends thereof in the width direction, in opposed relation to a ground below a ground surface; and an inward-side protruding portion formed to protrude from the reverse surface of the plate body and inserted into a space between the pair of strip members, wherein the inward-side protruding portion has a pair of outer side surfaces each being in surface contact with the inner side surfaces of the pair of strip members extending in the circulating movement direction. The excavation blade plate is fastened to the chain by a plurality of fastening members, in a direction parallel to the circulating movement plane and orthogonal to the width direction, in such a manner that the outer peripheral surface of the chain and the reverse surface of the plate body come into press contact with each other.

According to a third aspect of the present invention, there is provided excavating a method for forming a continuous trench below a ground surface by circulatingly moving an endless-shaped chain and a plurality of excavation blade plates integrally around a given support member, wherein: the chain includes a pair of strip members each formed in an endless shape and disposed with a distance therebetween in a given width direction, and a coupling member coupling the pair of strip members together in such a manner as to enable the distance between the pair of strip members to be kept constant, wherein the chain is movable in a given circulating movement plane orthogonal to the width direction, in a given circulating movement direction; and the plurality of excavation blade plates are fixed to an outer peripheral surface of the chain at intervals in the circulating movement direction of the chain, wherein each of the excavation blade plates includes: a plate body having an obverse surface and a reverse surface; and a plurality of excavation blades arranged on the obverse surface of the plate body at least at opposite ends thereof, in opposed relation to a ground below the ground surface. The excavating method comprises a preparation step and an excavation step. The preparation step includes: fittingly attaching each of the excavation blade plates to the chain such that an inward-side protruding portion protruding from the reverse surface of the plate body of the excavation blade plate is inserted into a space between the pair of strip members, wherein each of a pair of outer side surfaces of the inward-side protruding portion extending in the circulating movement direction is brought into surface contact with an inner side surfaces of the pair of strip members extending in the circulating movement direction, and fastening, by a plurality of fastening members, the chain and the excavation blade plates together in a direction parallel to the circulating movement plane and orthogonal to the width direction, in such a manner that outer peripheral surfaces of the pair of strip members and the reverse surface of the plate body of each of the excavation blade plates are brought into press contact with each other. The excavation step includes circulatingly moving the chain around the support member and moving the support member in a given forward movement direction to excavate the ground by the excavation blades, while restraining each of the excavation blade plates from being rotated in a plane parallel to the plate body due to reaction forces applied from the ground to the excavation blades, by means of the contact between the outer side surfaces of the inward-side protruding portion and the inner side surfaces of the pair of strip members.

DETAILED DESCRIPTION

Figure 1:
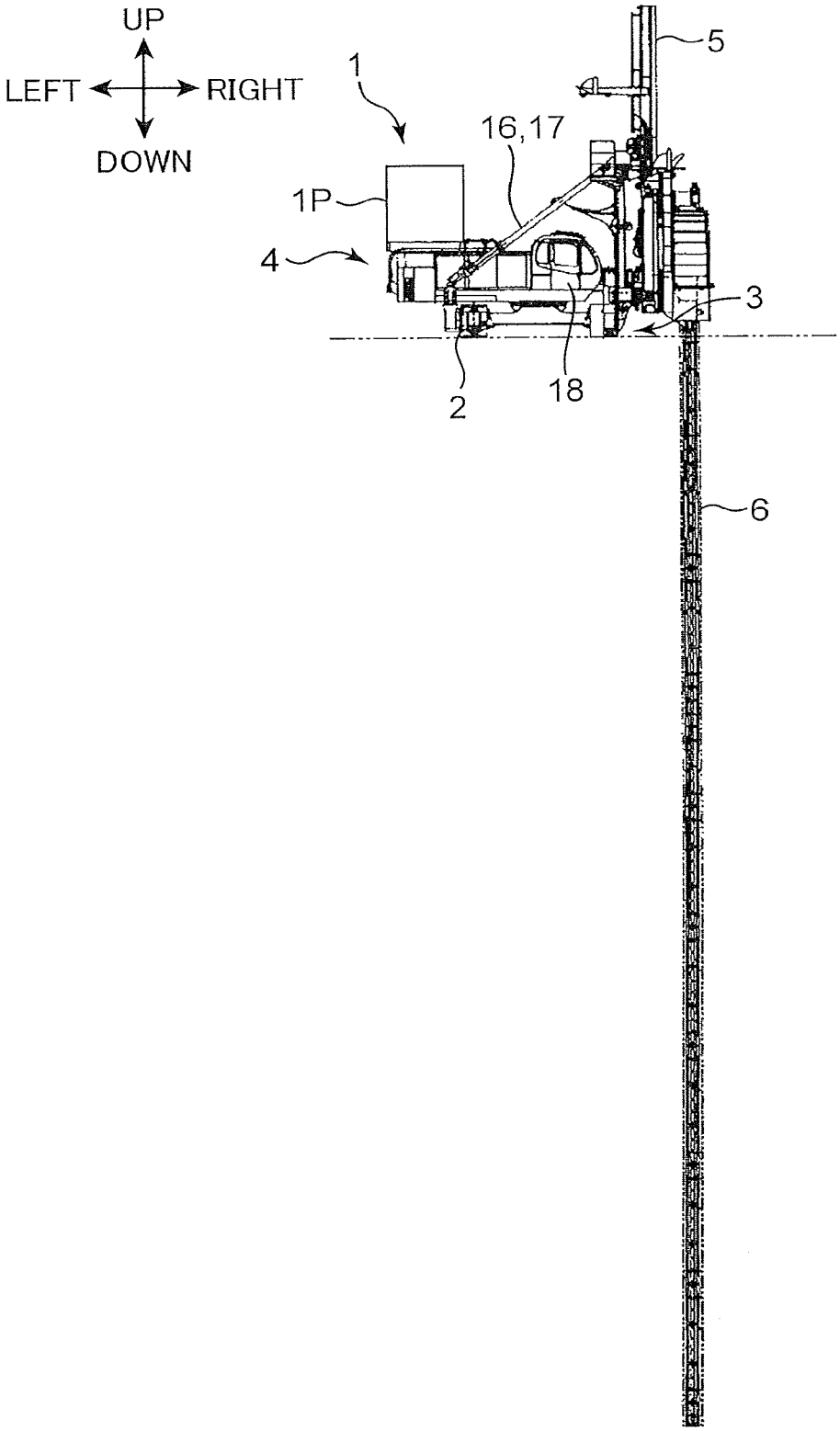
FIG. 1 is a side view depicting an overall configuration of an excavating apparatus according to one embodiment of the present invention.
Figure 2:
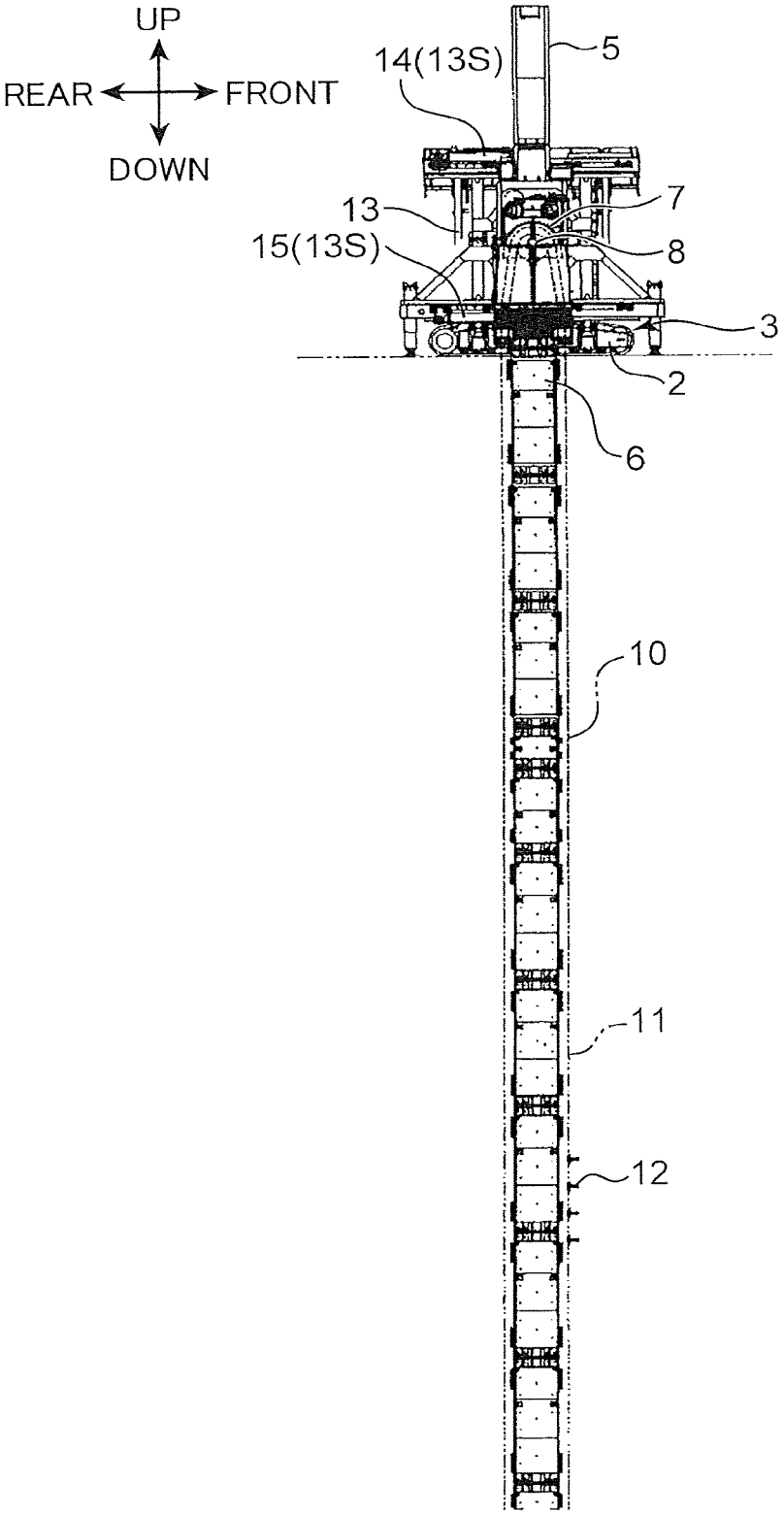
FIG. 2 is a front view depicting the overall configuration of the excavating apparatus according to this embodiment.

With reference to the drawings, the present invention will now be described based on a preferred embodiment thereof. FIG. 1 is a side view depicting a trench excavator 1 (excavating apparatus) according to one embodiment of the present invention, and FIG. 2 is a front view depicting the trench excavator 1. In each figure, directions, such as "up", "down", "front" and "rear", are indicated. However, it should be noted that these directions are shown only for the sake of describing a structure of a trench excavator 1 and an excavating method according to the present invention, but not meant to limit a usage mode and others of the trench excavator 1.

Figure 3:
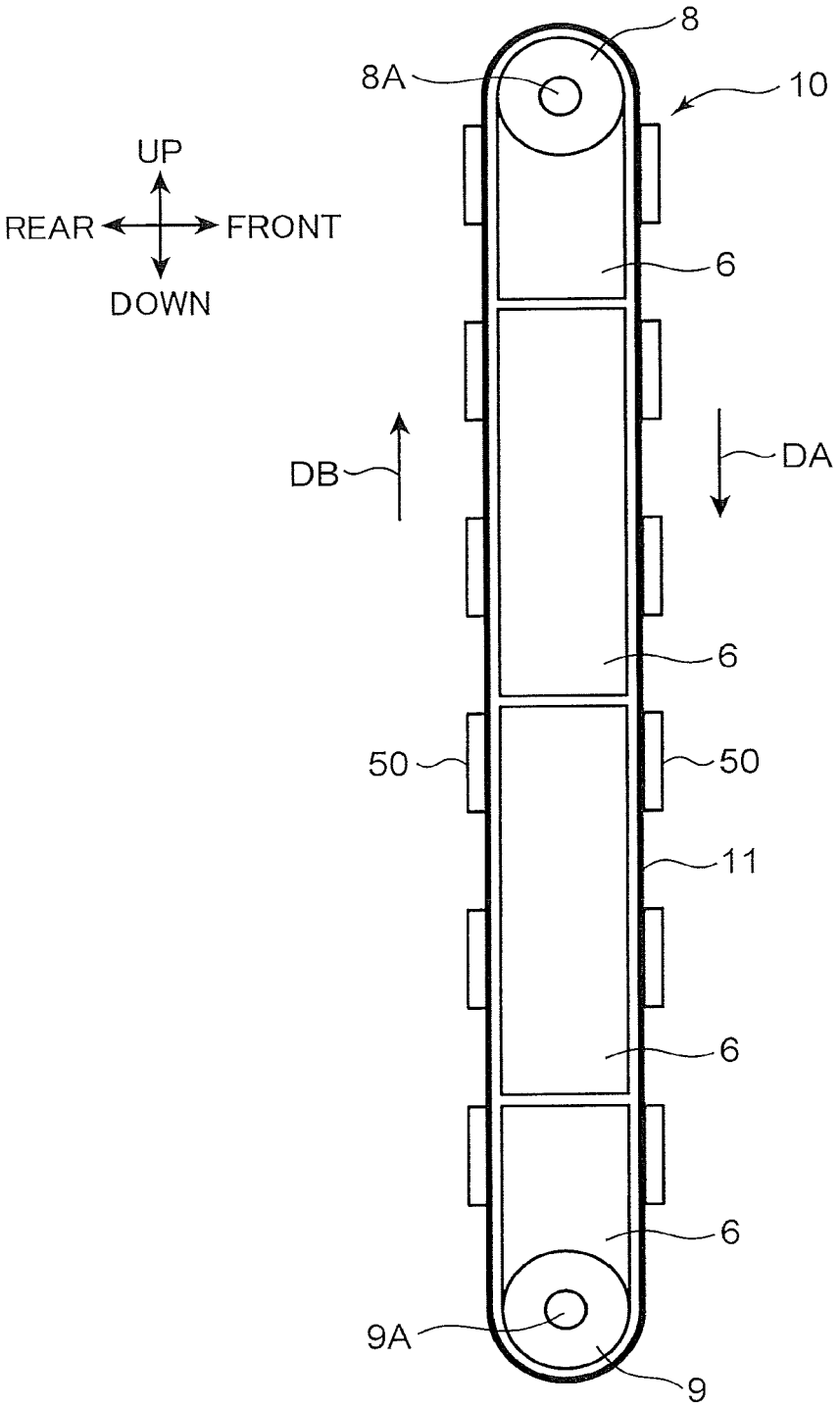
FIG. 3 is a schematic side view depicting a support member and a chain-type cutter of the excavating apparatus according to this embodiment.

This trench excavator 1 includes a lower traveling body 3 equipped with a crawler 2 capable of moving on a ground surface, an upper slewing body 4 (apparatus body) mounted on the lower traveling body 3, a leader 5 provided on the upper slewing body 4 in a liftable and lowerable manner, a cutter post 6 (support member) suspended from the leader 5 and disposed below the ground surface, a rotary drive device 7 (chain drive section), a moving mechanism 13S, and a power unit 1P. FIG. 3 is a schematic side view depicting structures of the cutter post 6 and a chain-type cutter 10 of the trench excavator 1 according to this embodiment.

The cutter post 6 is a rectangular parallelepiped-shaped box-like member, and a plurality of cutter posts 6 is coupled to each other in an upward-downward direction. The rotary drive device 7 includes a hydraulically-driven drive roller 8, and an idler roller 9 (FIG. 3). The drive roller 8 and the idler roller 9 are disposed, respectively, at an upper end and a lower end of the cutter posts 6. The chain cutter 10 is wound around between the drive roller 8 and the idler roller 9 in a circulatingly movable manner. The rotary drive device 7 is operable to circulatingly move a chain 11 in a circulating movement direction DA (FIG. 3). The power unit 1P is operable to supply a hydraulic pressure to the rotary drive device 7.

As depicted in FIG. 3, the chain-type cutter 10 includes an endless-shaped chain 11, and a plurality of cutter bit plates 50 arranged on the side of an outer periphery of the chain 11. The chain 11 is supported by the cutter post 6 in such a manner as to be movable on an outer periphery of the cutter post 6 in a given circulating movement plane in a given circulating movement direction. The circulating movement plane of the chain 11 means a plane parallel to a surface of the drawing sheet of FIG. 3, i.e., a plane including a trajectory drawn by one of opposite side edges of the chain 11 during the circulating movement. The circulating movement direction of the chain 11 being circulatingly moved is indicated by the arrowed lines DA, DB in FIG. 3. Further, the term "width direction" of the chain 11 is equivalent to a direction orthogonal to each of the circulating movement plane and the circulating movement direction, i.e., a direction orthogonal to the surface of the drawing sheet of FIG. 3 (rightward-leftward direction in FIG. 3).

The cutter bit plates 50 are a plurality of plate-shaped members fixed to an outer peripheral surface of the chain 11 at intervals in the circulating movement direction of the chain 11. Each of the cutter bit plates 50 includes a plurality of excavation bits 12 (FIG. 2) (excavation blades). The excavation bits 12 are arranged at least at widthwise opposite ends of the cutter bit plate 50, in opposed relation to a ground below the ground surface. Each of the excavation bits 12 is composed of a cemented carbide tip. The cutter bit plates 50 are configured to be circulatingly moved integrally together with the chain 11 to thereby excavate the ground.

The drive roller 8 is provided with a tension adjustment mechanism for adjusting tension of the chain 11. In FIG. 3, according to a rotary drive force received from the drive roller 8, the chain-type cutter 10 is circulatingly movable such that a region thereof forward of the cutter post 6 is moved in the direction indicated by the arrowed line DA (vertically downward direction), and a region thereof rearward of the cutter post 6 is moved in the direction indicated by the arrowed line DB (vertically upward direction). The idler roller 9 is configured to be rotated while being driven by the chain 11 of the chain-type cutter 10. Further, as depicted in FIG. 3, the drive roller 8 includes a drive roller shaft 8A, and the idler roller 9 includes an idler roller shaft 9A.

The upper slewing body 4 is provided with a portal frame 13 (FIG. 2) on which the moving mechanism 13S (support member drive section) is disposed. The moving mechanism 13S includes an upper traverse cylinder 14 disposed on an upper portion of the portal frame 13, and a lower traverse cylinder 15 disposed on a lower portion of the portal frame 13. The upper traverse cylinder 14 and the lower transverse cylinder 15 are arranged in parallel relation to each other.

The lower traverse cylinder 15 is configured to move the cutter post 6 in a given forward movement direction (forward direction) according to thrust $F_{PL}$ thereof so as to push the cutter post 6 toward the ground. In this process, the upper traverse cylinder 14 is configured to generate a cylinder holding force in a direction opposite to the pushing force of the lower traverse cylinder 15.

The reference signs 16, 17 in FIG I denote a pair of backstays (only a front-side one of them appears in FIG. 1) supporting the leader 5. Further, a cabin 18 on which an operator can ride is mounted on the upper slewing body 4.

The trench excavator 1 is configured to perform excavation in such a manner as to move the excavation bits 12 of the chain-type cutter 10 in an approximately vertical direction while horizontally pushing the cutter post 6 inserted in the ground, i.e., by the principle of scraping or shaving using a plane, on a per-pattern basis. As used here, the term "one pattern (per pattern)" means a region to be excavated by a group of the excavation bits 12 provided in the chain-type cutter 10 in the circulating movement direction.

If the thrust $F_{PL}$ of the lower traverse cylinder 15 becomes insufficient, a traversing speed of excavation is lowered, resulting in disabling of excavation of the ground. As one example, a rated thrust $F_{PL}$ of the lower traverse cylinder 15 of the trench excavator 1 according to this embodiment is 539 kN.

In this regard, the following relation is satisfied:

$$Lp:tpx=Vb:Ve \quad \text{(Formula 1)},$$

where Vb: tangential speed (mm/sec), Ve: excavation speed (mm/Hr), Lp: one pattern length (mm) for full-face excavation, and tpx: cutting depth (mm) per pattern. The following Formula 2 is derived from the Formula 1:

$$tpx=Ve \times Lp/Vb \quad \text{(Formula 2)}$$

Thus, the cutting depth tpx per pattern can be calculated from Formula 2.

Figure 4:
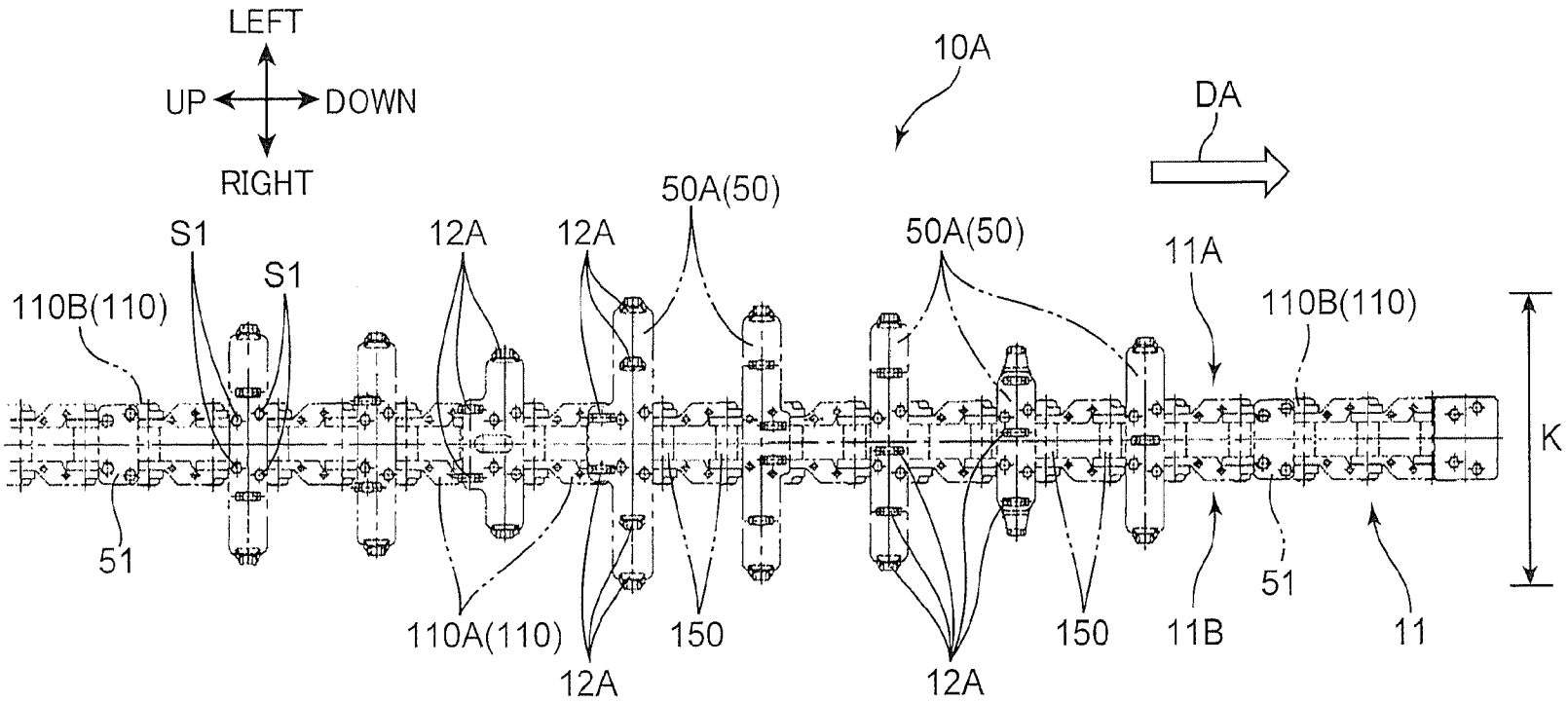
FIG. 4 is a front view depicting a portion of the chain-type cutter of the excavating apparatus according to this embodiment.
Figure 5:
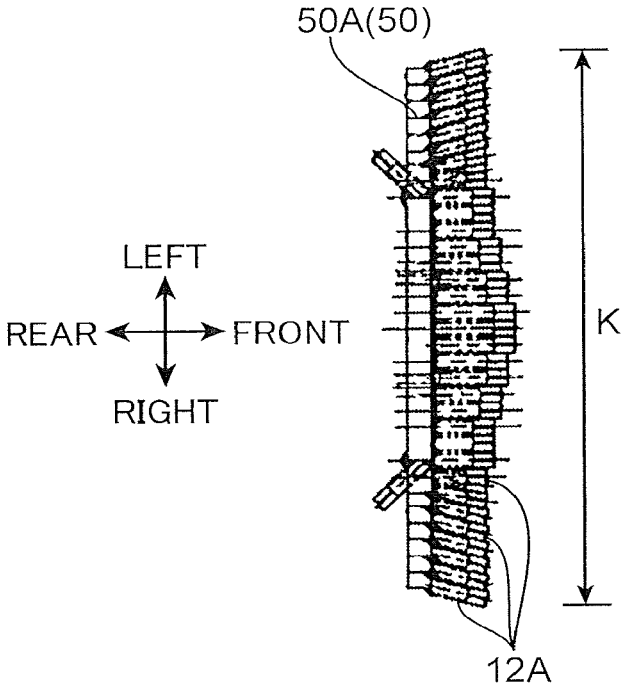
FIG. 5 is a top view depicting the portion of the chain-type cutter of the excavating apparatus according to this embodiment.
Figure 6:
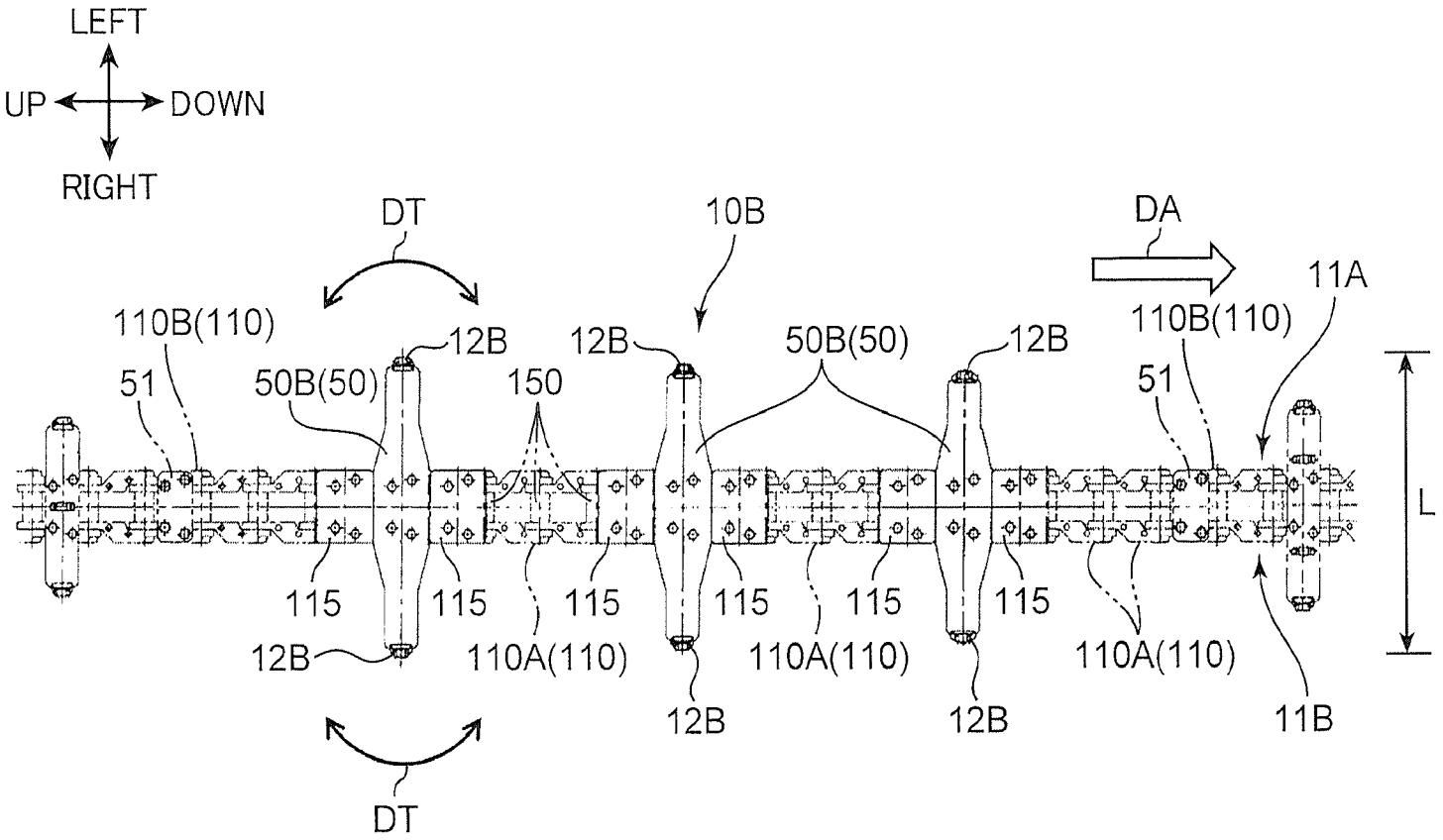
FIG. 6 is a front view depicting a portion of the chain-type cutter of the excavating apparatus according to this embodiment.
Figure 7:
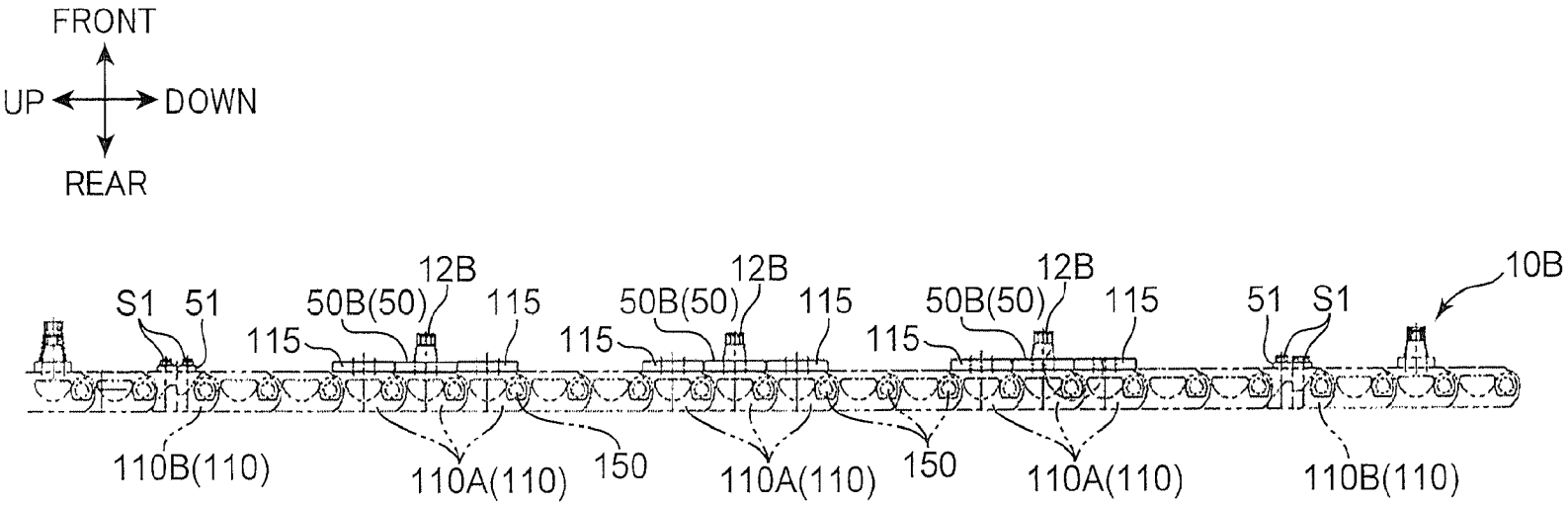
FIG. 7 is a side view depicting the portion of the chain-type cutter of the excavating apparatus according to this embodiment.
Figure 8:
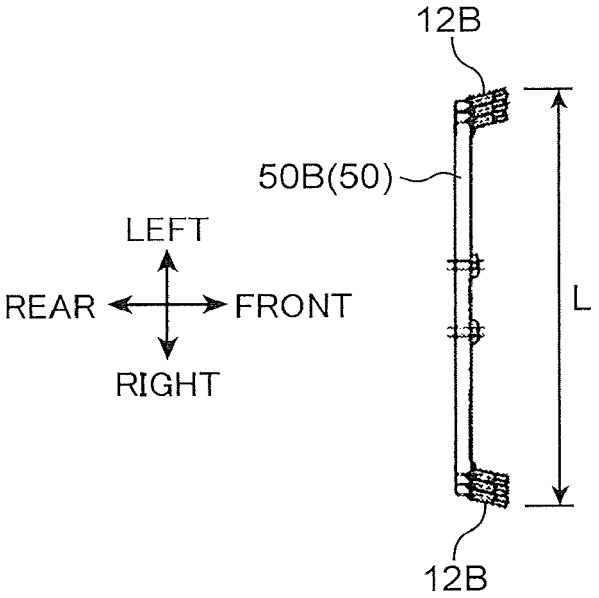
FIG. 8 is a top view depicting the portion of the chain-type cutter of the excavating apparatus according to this embodiment.

FIG. 4 is a front view depicting a portion (10A) of the chain-type cutter 10 of the trench excavator 1 according to this embodiment. FIG. 5 is a top view depicting the portion (10A) of the chain-type cutter 10. FIG. 6 is a front view depicting a portion (10B) of the chain-type cutter 10 of the trench excavator 1, and FIG. 7 and FIG. 8 are, respectively, a side view and a top view depicting the portion (10B) of the chain-type cutter 10.

The chain-type cutter 10 in this embodiment is formed by alternately coupling a first cutter unit 10A depicted in FIG. 4 and a second cutter unit 10B depicted in FIG. 6, in the circulating movement direction of the chain-type cutter 10. The mode of coupling between the first cutter unit 10A and the second cutter unit 10B is not limited thereto, but may be any suitable mode such as a mode in which two first cutter units 10A are successively coupled together, and then a second cutter unit 10B is coupled thereto. In this embodiment, the alternately coupled first and second cutter units 10A, 10B include the aforementioned group of excavation bits 12.

The chain 11 constituting the alternately coupled first and second cutter units 10A, 10B is formed by arranging and mutually coupling a plurally of pairs of links 110A or half links 110B in the circulating movement direction (see FIG. 7), wherein each of the pairs of links 110A or half links 110B are arranged with a distance therebetween in the width direction of the chain 11. In this embodiment, one half-link 110B is interposed between two groups of seventeen links 110A. Adjacent ones of the links 110A and the half-links 11B are coupled together by a fixing pin 150 (FIG. 7). In other words, the chain 11 includes a pair of strip members 11A, 11B (FIG. 6) each formed in an endless shape and arranged with a distance therebetween in the width direction, and a fixing pin 150 coupling the pair of strip members 11A, 11B together in such a manner as to enable the distance between the strip members to be kept constant. Outer peripheral surfaces of the strip members 11A, 11B are equivalent to the outer peripheral surface of the chain 11. Each of the strip members 11A, 11B includes a plurality of links 110A (half-links 110B) arranged side-by-side in adjacent relation to each other in the circulating movement direction, and a fixing pin 150 coupling adjacent ones of the links 110A together. That is, the fixing pin 150 mutually couples the strip members 11A, 11B arranged in adjacent relation in the width direction, and mutually couples adjacent ones of the links 110A arranged side-by-side along the circulating movement direction.

Figure 12:
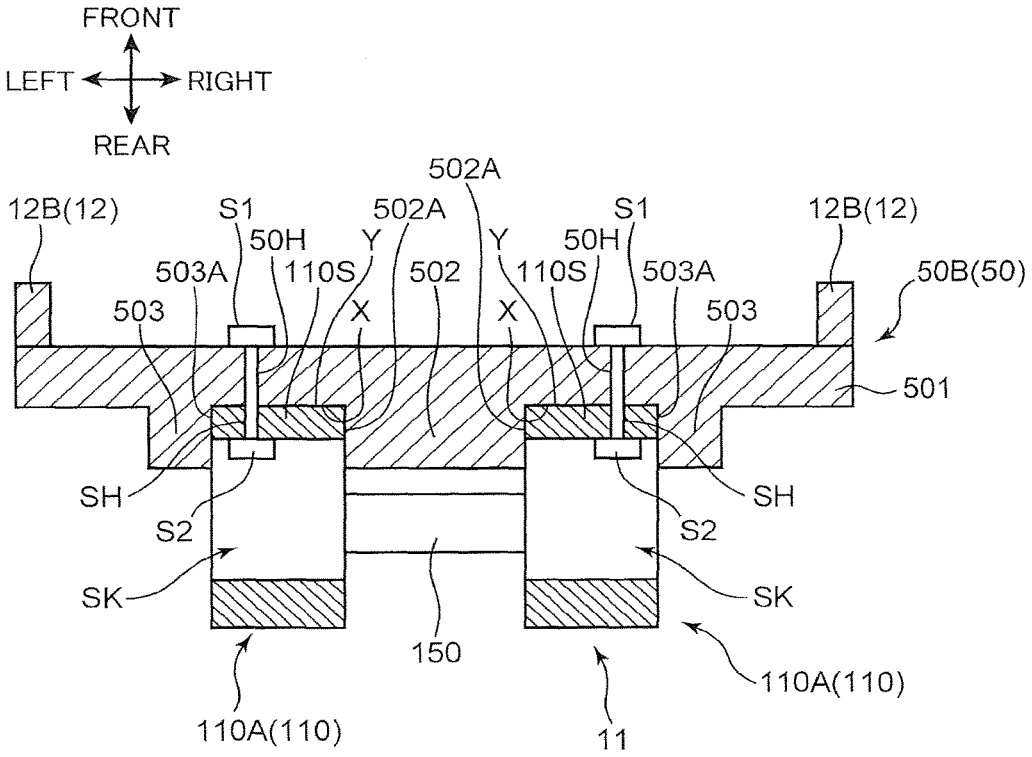
FIG. 12 is a sectional view depicting the chain and an excavation blade plate of the excavating apparatus according to this embodiment.
Figure 13:
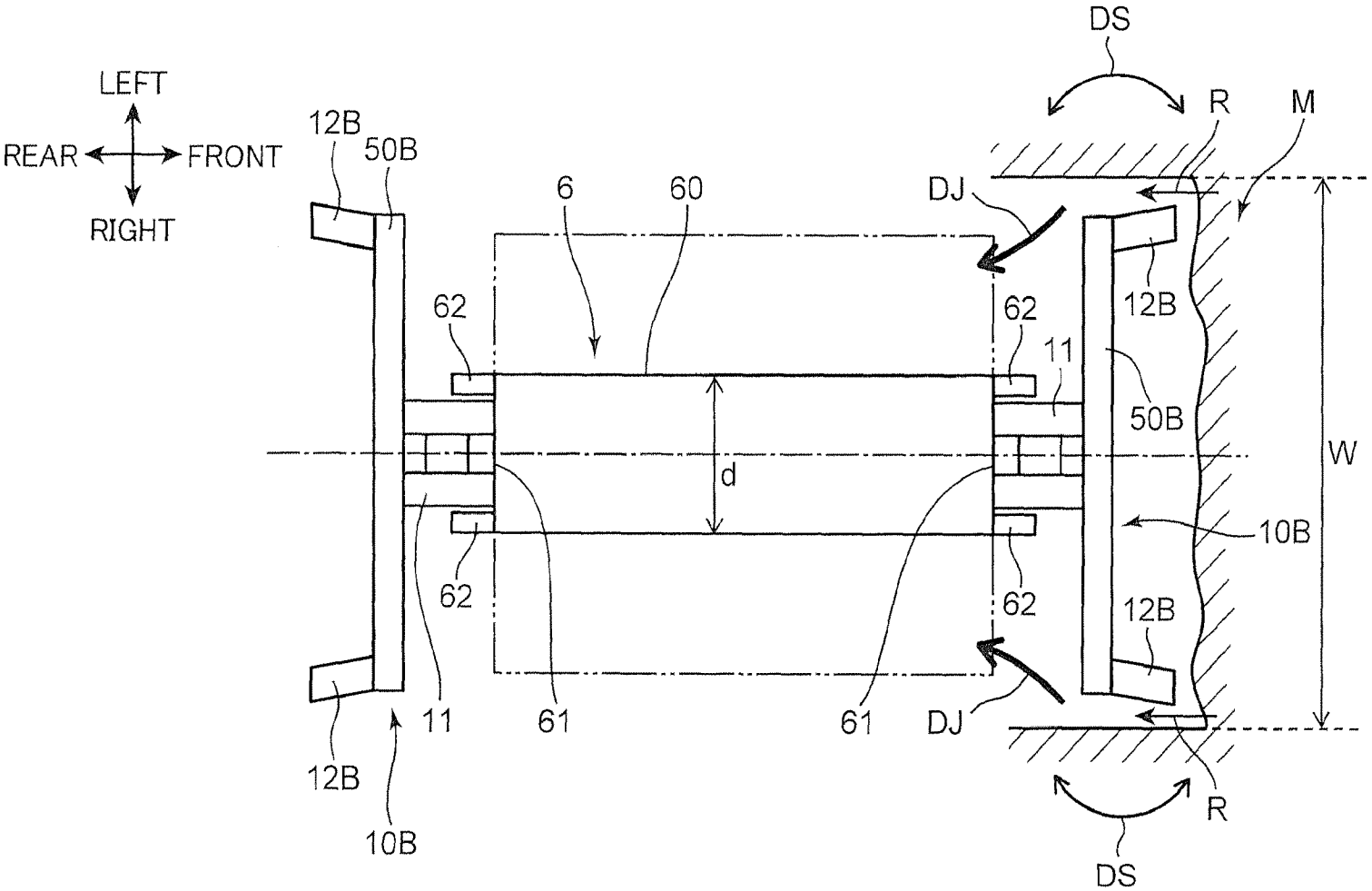
FIG. 13 is a schematic sectional view depicting the support member and the chain-type cutter of the excavating apparatus according to this embodiment.

The first cutter unit 10A has a function of excavating a widthwise inward region of an excavation width W by which the chain-type cutter 10 can excavate a ground (see FIG. 13). The first cutter unit 10A includes a plurality of first cutter bit plates 50A fixed on the chain 11. In this embodiment, eight first cutter bit plates 50A are arranged per first cutter unit 10A. Each of the first cutter bit plates 50A is one example of the cutter bit plate 50. Each of the first cutter bit plates 50A is fixed onto the links 110A of the chain 11 by plural (four) sets of a shoe bolt S1 and a nut S2 (FIG. 4, FIG. 12). The first cutter bit plates 50A of the first cutter unit 10A are configured such that respective widthwise lengths thereof become different from each other. It should be noted that the widthwise lengths of some of the first cutter bit plates 50A may be set to the same value.

A plurality of first excavation bits 12A are fixed on each of the first cutter bit plates 50A. In this embodiment, a maximum span K of the first excavation bits 12A of the first cutter unit 10A is set to 850 mm. As depicted in FIG. 5, when viewing the first cutter bit plates 50A in the circulating movement direction DA, the first excavation bits 12A provided on each of the first cutter bit plate 50A are continuously arranged over the entire maximum span K in the width direction. As a result, a region of the excavation width W of the ground corresponding to the maximum span K will be excavated by the first cutter unit 10A.

Referring to FIGS. 6 to 8, the second cutter unit 10B has a function of excavating a widthwise outward region of the excavation width W by which the chain-type cutter 10 can excavate the ground (see FIG. 13).

The second cutter unit 10B includes a plurality of second cutter bit plates 50B fixed on the chain 11. Each of the second cutter bit plates 50B is another example of the cutter bit plate 50. In this embodiment, three second cutter bit plates 50B are provided per second cutter unit 10B. It should be noted that two cutter bit plates appearing at opposite ends in FIG. 6 are the first cutter bit plates 50A (FIG. 4) of the adjacent first cutter units 10A. Each of the second cutter bit plates 50B is fixed onto a corresponding one of the links 110A of the chain 11 by plural sets of a shoe bolt S1 and a nut S2 (FIG. 7, FIG. 12).

Each of the second cutter bit plates 50B is configured such that a widthwise length thereof become slightly different from those of the first cutter bit plates 50A. A plurality of second excavation bits 12B are fixed on each of the second cutter bit plates 50B. In this embodiment, a maximum span L of the second excavation bits 12B is set to 1000 mm. As depicted in FIG. 8, when viewing the second cutter bit plates 50B in the circulating movement direction DA, the second excavation bits 12B provided on each of the second cutter bit plate 50B are concentratedly arranged at widthwise opposite ends of the maximum span L. As a result, a region of the excavation width W of the ground corresponding to the widthwise opposite ends of the maximum span L will be excavated by the second cutter unit 10B.

The second cutter unit 10B also includes a scrum plate 115. As depicted in FIGS. 6 and 7, a pair of scrum plates 115 is arranged, respectively, on upstream and downstream sides of each of the second cutter bit plates 50B in the circulating movement direction DA. Each of the scrum plates 115 is fixed onto a corresponding one of the links 110A by plural (four) sets of a shoe bolt S1 and a nut S2. The pair of scrum plates 115 are arranged across the second cutter bit plate 50B, in such a manner that one side edge of each of the scrum plates 115 is in contact with a corresponding one of opposite side edges of the second cutter bit plate 50B.

Figure 9:
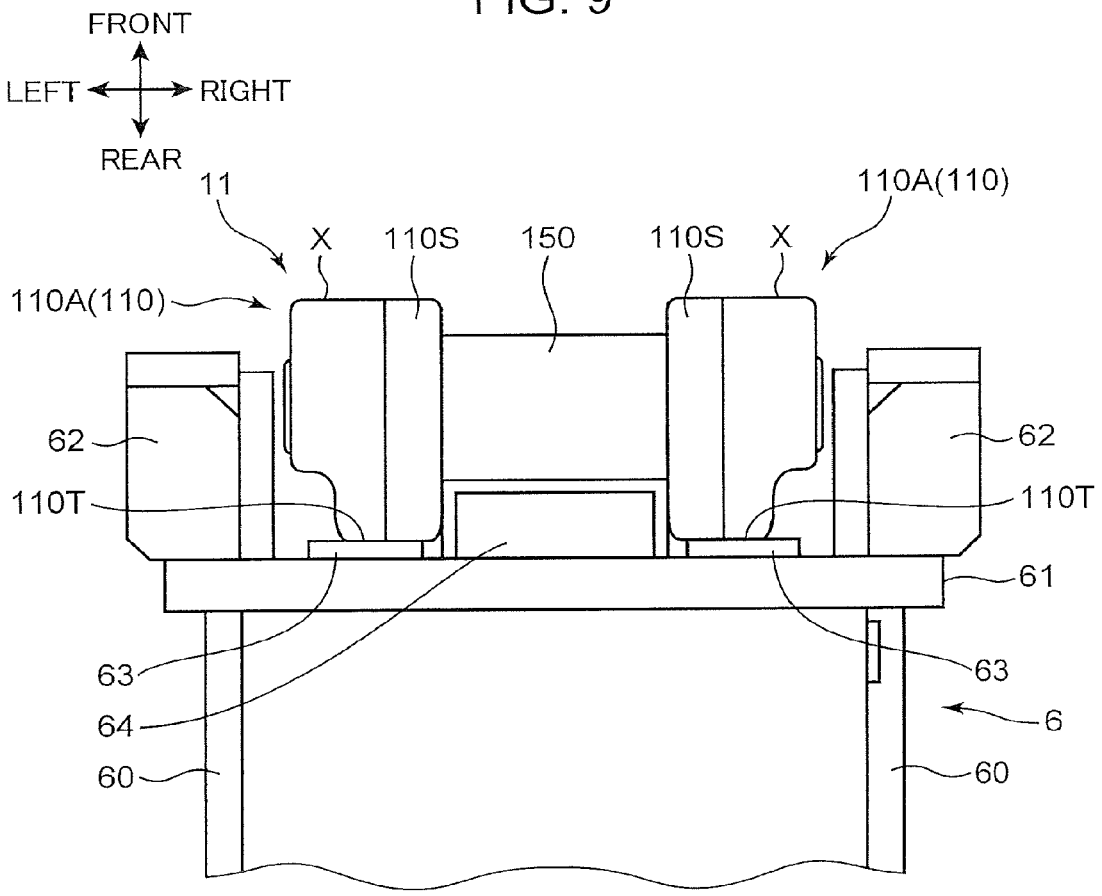
FIG. 9 is a sectional view depicting a support member and a chain of the excavating apparatus according to this embodiment.
Figure 10:
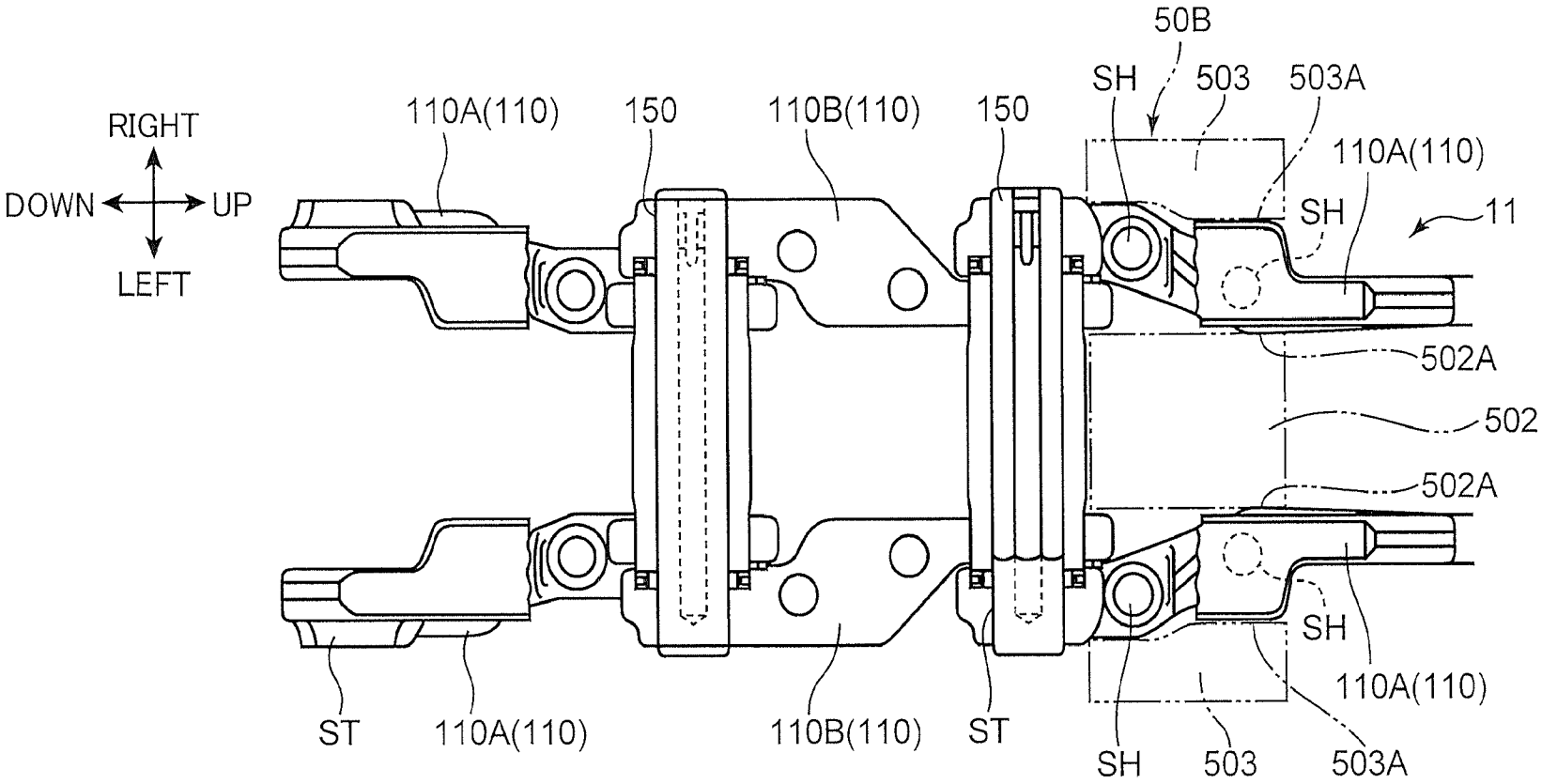
FIG. 10 is an enlarged front view depicting a portion of the chain of the excavating apparatus according to this embodiment.
Figure 11:
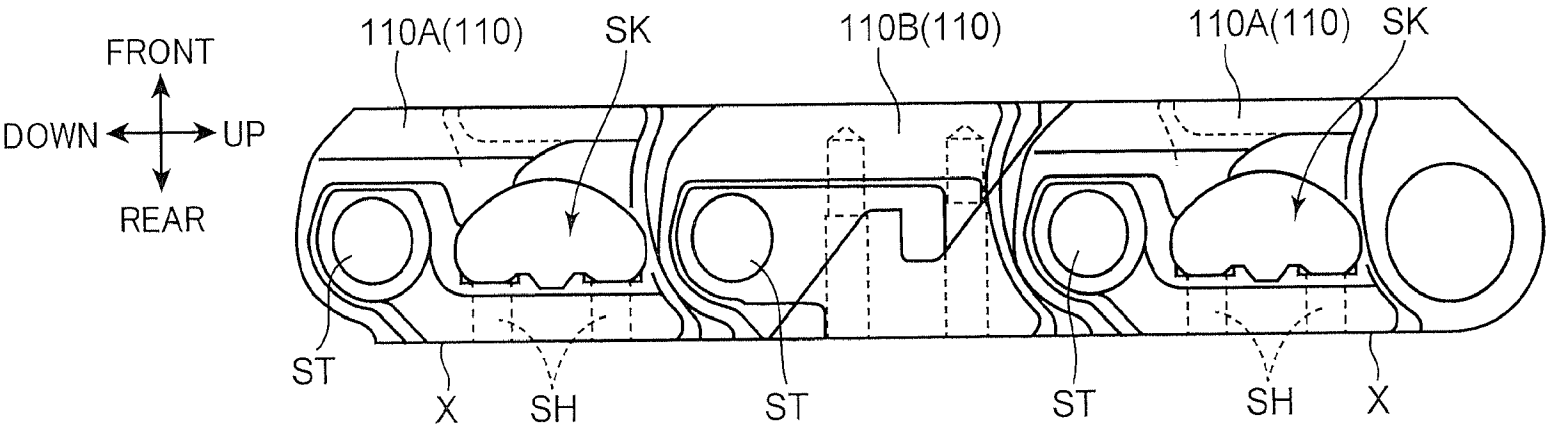
FIG. 11 is an enlarged side view depicting a portion of the chain of the excavating apparatus according to this embodiment.

FIG. 9 is a sectional view depicting the cutter post 6 and the chain 11 of the trench excavator 1 according to this embodiment. FIG. 10 is an enlarged front view depicting a portion of the chain 11 of the trench excavator 1, and FIG. 11 is an enlarged side view depicting a portion of the chain 11 of the trench excavator 1. FIG. 12 is a sectional view depicting the chain 11 and the second cutter bit plate 50B of the trench excavator 1.

Referring to FIG. 9, the cutter post 6 includes: a pair of lateral walls 60; a pair of support walls 61 each connecting the pair of lateral walls 60 together; a pair of opposing walls 62; a sliding portion 63; and a cutter post convex portion 64. It should be noted that, while FIG. 9 enlargedly depicts only a front end of the cutter post 6, the support wall 61, the pair of opposing walls 62, the sliding portion 63 and the cutter post convex portion 64 are provided on the side of a rear end of the cutter post 6 in the same manner as that in FIG. 9.

The support wall 61 is a wall of the cutter post 6 supporting a chain-type cutter 10. The pair of opposing walls 62 are formed to protrude forwardly from opposite ends of the support wall 61 in a rightward-leftward direction. The chain 11 is received in a space between the pair of opposing walls 62. Each of the pair of sliding portions 63 is a plate-shaped member fixed to the support wall 61 at a position inward of the pair of opposing walls 62. As each of the sliding portions 63, a member having low frictional resistance and high slidability is employed. The cutter post convex portion 64 is a portion protruding from the support wall 61 at a position between the pair of sliding portions 63. The cutter post convex portion 64 is disposed between a pair of links 110A. Each of the opposing walls 62, the sliding portions 63 and the cutter post convex portion 64 extends long over the entire length of the cutter post 6 in the upward-downward direction, to have a function of guiding the circulating movement of the chain 11.

As depicted in FIGS. 9 and 12, when viewed in a cross-section orthogonal to the circulating movement direction of the chain 11, the pair of links 110A and the fixing pin 150 are formed in an approximately H-type shape. Each of the pair of links 110A includes a convex portion 110S and a sliding surface 110T. The convex portion 1105 is a portion of the link 110A protruding higher than the opposing walls 62. A distal end surface (outer peripheral surface) of the convex portion 110S of the link 110A is formed as a plate supporting surface X. The plate supporting surface X has a function of supporting one of a plurality of cutter bit plates 50. The sliding surface 110T is a base end surface of the link 110A, and slidable with a corresponding one of the pair of sliding portions 63 along with the circulating movement of the chain 11.

FIGS. 10 and 11 depict a region of the chain 11 in which two links 110A are arranged, respectively, on both sides of one half-link 110B. The link 110A and the half-link 110B are coupled together by the fixing pin 150, as described above. For this purpose, each of opposite ends of the link 110A and the half-link 110B is formed with a pin insertion hole ST for allowing the fixing pin 150 to be inserted thereinto (FIG. 11). Further, each of the links 110A has the plate supporting surface X, a cavity SK, and a shoe bolt insertion hole SH. The cavity SK is opened at a position between two pin insertion holes ST disposed in adjacent relation to each other in the circulating movement direction of the chain 11. The shoe bolt insertion hole SH extends from the cavity SK to the plate supporting surface X to serve as a hole for bolt fastening.

On the other hand, referring to FIG. 12, each of the second cutter bit plates 50B fixed to the chain 11 includes a plate body 501, a central convex portion 502 (inward-side protruding portion), a pair of lateral convex portions 503 (outward-side protruding portions), and the plurality of second excavation bits 12B.

The plate body 501 is a plate-shaped portion extending longer than the chain 11 in the width direction of the chain 11 (rightward-leftward direction), and has an obverse surface facing the ground and a reverse surface on a side opposite to the obverse surface. The second excavation bits 12B are fixed at opposite ends of the obverse surface of the plate body 501. The reverse surface (on a rear side of FIG. 12) of the plate body 501 is formed of two support-target surfaces Y. Each of the support-target surfaces Y is a flat surface extending in the rightward-leftward direction, and configured to be brought into contact with and supported by a respective one of the plate supporting surfaces X (outer peripheral surfaces) of the chain 11. The central convex portion 502 of the second cutter bit plate 50B is a protruding portion protruding from a central region of the support-target surfaces Y in the rightward-leftward direction. The pair of lateral convex portions 503 are a pair of protruding portions protruding from the support-target surfaces Y in such a manner as to be opposed to the central convex portion 502 in the width direction of the chain 11 (forward-rearward direction). Each of the pair of lateral convex portions 503 is disposed with a given distance with respect to the central convex portion 502. The pair of lateral convex portions 503 are arranged to clamp the pair of links 110A in cooperation with the central convex portion 502.

Referring to FIG. 10, an attaching position of the second cutter bit plate 50B is indicated by the one-dot chain line, around the pair of links 110A located upward of the pair of half-links 110B. In operation of attaching the second cutter bit plate 50B to the chain 11, the central convex portion 502 is inserted into a space between the pair of links 110K. In this process, each of two outer side surfaces 502A of the central convex portion 502 is oriented in the width direction and brought into surface contact with a respective one of inner side surfaces of the pair of links 110A extending in the circulating movement direction. Further, each of the pair of lateral convex portions 503 clamps a respective one of the pair of links 110A in the width direction (forward-rearward direction) in cooperation with the central convex portion 502, wherein an inner side surface 503A of each of the pair of lateral convex portions 503 is oriented in the width direction and brought into surface contact with an outer side surface of a corresponding one of the pair of links 110A extending in the circulating movement direction. As a result, the pair of lateral convex portions 503, the pair of links 110A and the central convex portion 502 are arranged along the width direction (rightward-leftward direction) in a tight contact manner. Further, as depicted in FIG. 12, the support-target surfaces Y of the second cutter bit plate 50B are supported, respectively, by the plate supporting surfaces X of the chain 11.

After attaching the second cutter bit plate 50B to the pair of links 110A, a shoe bolt S1 is inserted into a bolt hole 50H of the cutter bit plate 50, as depicted in FIG. 12. A distal end of the shoe bolt S1 is inserted to penetrate through the shoe bolt insertion hole SH of the chain 11, and finally exposed to the cavity SK. Then, by an operator, a nut S2 is inserted from a lateral side of the chain 11 into the cavity SK, and attached and fixedly fastened to the distal end of the shoe bolt S1, so that the second cutter bit plate 50B is fixed to the chain 11. As mentioned above, each of the second cutter bit plates 50B is fixedly fastened to the chain 11 by four sets of the shoe bolt S1 and the nut S2 (FIG. 10). In this process, the shoe bolt S1 and the nut S2 fasten the chain 11 and the second cutter bit plate 50B together in a direction parallel to the circulating movement plane of the chain 11 and orthogonal to the width direction of the chain 11 (forward-rearward direction), in such a manner that the outer peripheral surface of the chain 11 (strip members 11A, 11B) and the reverse surface of the plate body 501 come into press contact with each other.

In this embodiment, each of the second cutter bit plates 50B of the second cutter unit 10B is fixed to the chain 11 by the structure as depicted in FIG. 12. On the other hand, each of the first cutter bit plates 50A of the first cutter unit 10A is devoid of the central convex portion 502 and the lateral convex portions 503 in FIG. 12. That is, a reverse surface of each of the first cutter bit plates 50A is entirely formed as a flat support-target surface Y in the rightward-leftward direction. In the first cutter unit 10A, each of the first cutter bit plates 50A is fixed to the chain 11 by four sets of a shoe bolt S1 and a nut S2, as with the second cutter unit 10B. In the first cutter unit 10A, the support-target surface Y of each of the first cutter bit plates 50A is supported by the plate supporting surfaces X of the chain 11.

FIG. 13 is a top view of the cutter post 6 and the second cutter unit 10B of the trench excavator 1 according to this embodiment. In FIG. 13, depiction of the central convex portion 502 and the lateral convex portions 503 in FIG. 12 are omitted. As mentioned above, the second cutter unit 10B has a function of excavating the widthwise outward region of the excavation width W (FIG. 13) over which the chain-type cutter 10 excavates the ground. That is, the excavation width W of the chain-type cutter 10 is determined by the second cutter unit 10B. In a conventional excavating apparatus for use in forming a continuous wall such as a soil-cement wall for water cut-off or substruction, the excavation width W has been set within 850 mm, in many cases. On the other hand, recently, it is expected to enable such a continuous wall to be employed as an exterior wall, as well as a water cut-off wall and a substruction wall, thereby leading to a need to increase the excavation width W.

As depicted in FIG. 13, when the excavation width W is increased under a condition that a width d of the cutter post 6 is fixed, a posture of the second cutter bit plate 50B is likely to become unstable. In the case where there is a difference between reaction forces R received from a ground M by a pair of second excavation bits 12B of the second cutter bit plate 50B, a rotational moment indicated by the arrowed line DS (a moment causing the second cutter bit plate 50B to be rotated in a cross-section orthogonal to a circulating movement direction of the chain-type cutter 10) is given to the second cutter bit plate 50B. Further, when the second cutter bit plate 50B is moved around the cutter post 6 together with the chain 11, a rotational moment indicated by the arrowed line DT in FIG. 6 (a moment causing the second cutter bit plate 50B to be rotated in a plane including the circulating movement direction of the chain-type cutter 10 and the width direction of the chain 11) is given to the second cutter bit plate 50B, due to contact resistances of the second excavation bits 12B with respect to the ground M. When such rotational moments are given to the second cutter bit plate 50B, a large shear force is applied to the shoe bolt S1 by which the second cutter bit plate 50B and the chain 11 are fixedly fastened together, possibly leading to loosening, disengagement, breakage or the like of the shoe bolt S1. Such rotational moments notably occur in the second cutter bit plate 50B having a widthwise length set to be greater than that of the first cutter bit plate 50A.

In FIG. 13, with a view to stabilizing the posture of the second cutter bit plate 50B, it is conceivable to increase the width d of the cutter post 6 so as to form the cutter post 6 to have the shape indicated by the dotted line in FIG. 13. In this case, however, the cutter post 6 is disposed on back sides of the second excavation hits 12B (on back sides of opposite ends of the second cutter bit plate 50B). This prevents soil of the ground excavated by the second excavation bits 12B from flowing as indicated by the arrowed lines DJ. Thus, a large pressure is applied around the second cutter hit plate 50B, leading to difficulty in circulating movement and forward movement of the chain-type cutter 10. In other words, in the case where a maximum span of the second excavation bits 12B of the second cutter bit plate 50B is set to be greater than the width d of the cutter post 6, as in FIG. 13, the flow of excavated soil (arrowed lines DJ) is smoothly formed, so that it becomes possible to smoothly perform excavation operation for a wider excavation width W. As a result of plural experiments, the present inventor found that, in the case where the maximum span L (FIG. 6) of the pair of second excavation bits 12B of the second cutter bit plate 50B is 1000 mm or more, the above effect is significantly brought out by satisfying the following relationship: $L \geq d \times 2.5$. On the other hand, the use of such a structure leads to the problem of the rotational moments received by the second cutter bit plate 50B and the resulting shear force applied to the shoe bolt S1.

In order to solve this problem, each of the second cutter bit plates 50B in this embodiment has the structure as depicted in FIGS. 10 to 12. That is, when each of the second cutter bit plates 50B is circulatingly moved around the cutter post 6 together with the chain 11 while excavating the ground M, each of the outer side surfaces 502A of the central convex portion 502 is in tight contact with a respective one of the inner side surfaces of the pair of links 110A. Further, the inner side surface 503A of each of the pair of lateral convex portions 503 is in tight contact with the outer side surface of a corresponding one of the pair of links 110A. Thus, even in a situation where, during excavation of the ground, a moment (the arrowed line DT in FIG. 6) causing the second cutter bit plate 50B to be rotated in a plane parallel to the plate body 501 due to the reaction forces R received from the ground by the second excavation bits 12B is likely to be generated, the rotation of the cutter bit plate 50 is restrained by contact between corresponding ones of the outer side surfaces 502A of the central convex portion 502 and the inner side surfaces of the pair of links 110A (pair of strip members 11A, 11B). This makes it possible to reduce a shear force to be applied to the shoe bolt S1 which fixes the cutter bit plate 50–. As a result, it becomes possible to suppress loosening, disengagement, breakage or the like of the shoe bolt S1. In other words, in this embodiment, with a view to suppressing the rotation of each of the second cutter bit plates 50B in a cross-section orthogonal to the circulating movement direction of the chain-type cutter 10, each of the outer side surfaces 502A of the central convex portion 502 of the second cutter bit plate 50B is in tight contact with a respective one of the inner side surfaces of the pair of links 110A, and the inner side surface of each of the pair of lateral convex portions 503 is in tight contact with the outer side surface of a corresponding one of the pair of links 110A.

In this embodiment, each of the second cutter bit plates 50B is disposed such that it is sandwiched between a pair of scrum plates 115 each firmly attached thereto, as depicted in FIGS. 6 and 7. Thus, the rotational moment as indicated by the arrowed line DT in FIG. 6 is much less likely to occur in each of the second cutter bit plates 50B.

In this embodiment, each of a contact region between the central convex portion 502 and each of the pair of links 110A, and a contact region between each of the pair of lateral convex portions 503 and a corresponding one of the pair of links 110A is set to a planar shape having a given length in the frontward-rearward direction and the upward-downward direction (set as a surface contact region), as depicted in FIG. 12. Thus, the rotational moment as indicated by the arrowed line DS in FIG. 13 is less likely to occur in the second cutter bit plate 50B. As a result, it becomes possible to reduce a shear force to be applied to the shoe bolt S1 to thereby further suppress occurrence of loosening, disengagement, breakage or the like of the shoe bolt S1.

In this embodiment, as depicted in FIG. 10, the central convex portion 502 of the second cutter bit plate 50B is set to a shape fittable in the space between the pair of links 110A. This makes it possible to enable an operator to easily attach the second cutter bit plate 50B to a given position of the chain 11. The central convex portion 502 is fitted in the space between the pair of links 110A of the chain 11, and the pair of lateral convex portions 503 are fitted, respectively, on the outer side surfaces of the pair of links 110A, so that it becomes possible to restrain a shape of the chain 11 and prevent loosening of the chain 11. In this case, an edge face of the central convex portion 502 orthogonal to the two outer side surfaces 502A is disposed in opposed relation to the fixing pin 150 (FIG. 10).

In this embodiment, the cutter bit plates 50 each having the excavation bits 12 are directly attached to the chain 11. Thus, as compared to case where an additional positioning member is disposed between the cutter bit plate 50 and the chain 11, it becomes possible to reduce the weight of the chain-type cutter 10 and thus reduce a load to be imposed on the chain 11 during the circulating movement.

In this embodiment, between the maximum span L of the second excavation bits 12B in FIG. 6 and the width d of the cutter post 6 in FIG. 13, the following relationship is satisfied: $L \geq d \times 2.5$, so that, even in the case where it is necessary to excavate a relatively wide region below the ground surface, it becomes possible to reduce a shear force to be applied to the shoe bolt S1, while stably performing the circulating movement of the chain 11 and the forward movement of the cutter post 6.

The above embodiment also discloses a second cutter bit plate 50B which is fixed to an outer peripheral surface of an endless-shaped chain 11 supported by a given cutter post 6 in such a manner as to be movable on an outer periphery of the cutter post 6 along a given circulating movement plane in a given circulating movement direction, wherein the chain 11 includes a pair of strip members 11A, 11B each formed in an endless shape and disposed with a distance therebetween in a given width direction, and a coupling member 150 coupling the pair of strip members 11A, 11B together in such a manner as to enable the distance between the pair of strip members 11A, 11*b* to be kept constant. The second cutter bit plate 50B includes: a plate body 501 extending longer than the chain 11 in the width direction of the chain 11 orthogonal to each of the circulating movement plane of the chain 11 and the circulating movement direction of the chain 11, and having an obverse surface and a reverse surface; a plurality of excavation bits 12B arranged on the obverse surface of the plate body 501 at least at opposite ends thereof in the width direction, in opposed relation to a ground below a ground surface; and a central convex portion 502 formed to protrude from the reverse surface of the plate body 501 and inserted into a space between the pair of strip members 11A, 11B, wherein the central convex portion 502 has a pair of outer side surfaces 502A each being in surface contact with a respective one of inner side surfaces of the pair of strip members 11A, 11B extending in the circulating movement direction. The second cutter bit plate 50B is fastened to the chain 11 by plural sets of a shoe bolt S1 and a nut S2, in a direction parallel to the circulating movement plane of the chain 11 and orthogonal to the width direction of the chain 11, in such a manner that the outer peripheral surface of the chain 11 and the reverse surface of the plate body 501 come into press contact with each other.

In this embodiment, the second cutter bit plate 50B further includes a pair of lateral convex portions 503 each formed to protrude from the reverse surface of the plate body 501 in such a manner as to clamp a respective one of the pair of strip members 11A, 11B in the width direction in cooperation with the central convex portion 502, wherein each of the pair of lateral convex portions 503 has an inner side surface 503A being in surface contact with an outer side surface of a corresponding one of the pair of strip members 11A, 11B extending in the circulating movement direction.

The above embodiment further discloses an excavating method for forming a continuous trench below a ground surface by circulatingly moving an endless-shaped chain 11 and a plurality of second cutter bit plates 50B integrally around a given cutter post 6, wherein: the chain 11 includes a pair of strip members 11A, 11B each formed in an endless shape and disposed with a distance therebetween in a given width direction, and a fixing pin 150 coupling the pair of strip members 11A, 11B together in such a manner as to enable the distance between the pair of strip members 11A, 11B to be kept constant, wherein the chain 11 is movable along a given circulating movement plane orthogonal to the width direction, in a given circulating movement direction; and the plurality of second cutter bit plates 50B are fixed to an outer peripheral surface of the chain 11 at intervals along the circulating movement direction of the chain 11, wherein each of the second cutter bit plates 50B including: a plate body 501 having an obverse surface and a reverse surface; and a plurality of second excavation bits 12B arranged on the obverse surface of the plate body 501 at least at opposite ends thereof, in opposed relation to a ground below the ground surface. The excavating method comprises a preparation step and an excavation step. The preparation step includes fittingly attaching each of the second cutter bit plates 50B to the chain 11 such that a central convex portion protruding from the reverse surface of the plate body 501 of the second cutter bit plate is inserted into a space between the pair of strip members 11A, 11B, wherein each of a pair of outer side surfaces 502A of the central convex portion 502 extending in the circulating movement direction is brought into surface contact with a respective one of inner side surfaces of the pair of strip members 11A, 11B extending in the circulating movement direction, and fastening, by plural sets of a shoe bolt S1 and a nut S2, the chain 11 and the second cutter bit plates together in a direction parallel to the circulating movement plane and orthogonal to the width direction, in such a manner that outer peripheral surfaces of the pair of strip members 11A, 11B and the reverse surface of the plate body 501 are brought into press contact with each other. The excavation step includes circulatingly moving the chain 11 around the cutter post 6 and moving the cutter post 6 along a given forward movement direction to excavate the ground by the second excavation bits 12B, while restraining each of the second cutter bit plates 50B from being rotated in a plane parallel to the plate body 501 due to reaction forces R applied from the ground to the second excavation bits 12B, by means of the contact between corresponding ones of the outer side surfaces 502A of the central convex portion 502 and the inner side surfaces of the pair of strip members 11A, 11B.

In the above excavating method, the preparation step may include: providing a pair of lateral convex portions 503 formed to protrude from the reverse surface of the plate body 501, on both sides of and spaced-apart relation to the central convex portion in the width direction; fittingly attaching each of the second cutter bit plates 50B to the chain 11 such that each of the pair of lateral convex portions 503 clamps a respective one of the pair of strip members 11A, 11B in the width direction in cooperation with the central convex portion 502, wherein an inner side surface of each of the pair of lateral convex portions 503 extending in the circulating movement direction is brought into surface contact with an outer side surface of a corresponding one of the pair of strip members 11A, 11B extending in the circulating movement direction; and fastening, by a plurality of shoe bolts, the chain 11 and the second cutter bit plate 50B together. Further, the excavation step may include: excavating the ground by the second excavation bits 12B, while further restraining each of the second cutter bit plates 50B from being rotated in the plane parallel to the plate body 501 due to the reaction forces R applied from the ground to the second excavation bits 12B, by means of the contact between corresponding ones of the inner side surfaces 503A of the pair of lateral convex portions 503 and the outer side surfaces of the pair of strip members 11A, 11B.

In this excavating method, it becomes possible to reduce a moment given to each of the second cutter hit plates 50B during excavation of the ground, i.e., a moment causing the second cutter hit plate 50B to be rotated in a plane including the circulating movement direction of the chain 11 and the width direction of the chain 11. This makes it possible to reduce a shear force to be applied to the shoe bolt S1 which fixes the second cutter bit plate 50B.

In the above excavating method, respective widths of the cutter post 6 and the second cutter bit plate 50B and an arrangement of the second excavation bits 12B are set to satisfy the following relationship: $L \geq d \times 2.5$, where: d denotes a width of the cutter post 6 in the width direction; and L denotes a distance in the width direction between the second excavation bits 12B disposed at the opposite ends of the second cutter bit plate 50B.

In this excavating method, even in the case where it is necessary to excavate a relatively wide region of the ground below the ground surface, it becomes possible to reduce a shear force to be applied to the shoe bolt S1, while stably performing the circulating movement of the chain 11 and the forward movement of the cutter post 6.

As above, the trench excavator 1 and the second cutter bit plate 50B according to one embodiment of the present invention and the ground excavating method using the trench excavator 1 have been described. However, the present invention is not limited to the above embodiment. For example, the above embodiment may be modified as follows.

Figure 14:
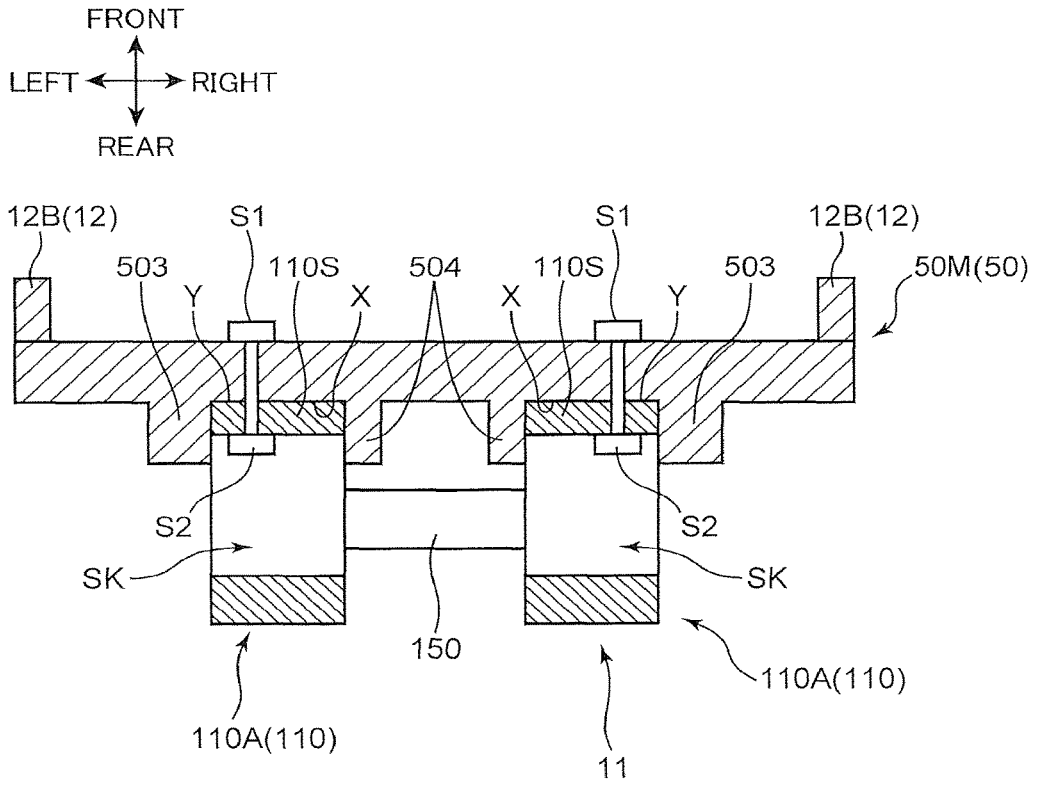
FIG. 14 is a sectional view depicting a chain and an excavation blade plate of an excavating apparatus according to a modified embodiment of the present invention.

(1) Although the above embodiment has been described based on an example where each of the second cutter bit plates 50B includes the central convex portion 502 and the lateral convex portions 503, the present invention is not limited thereto. For example, the second cutter bit plate 50B may have only the central convex portion 502 or may have only the pair of lateral convex portions 503. FIG. 14 is a sectional view depicting a state in which a cutter bit plate 50M in a modified embodiment of the present invention is fixed to the chain 11. The cutter bit plate 50M in this modified embodiment is different from the second cutter bit plate 50B in the above embodiment, in that a pair of inward-side convex portions 504 (inward-side protruding portion) are provided, instead of the central convex portion 502. In this case, each of outer side surfaces of the pair of inward-side convex portions 504 comes into contact (surface contact) with a respective one of the inner side surfaces of the pair of links 110A along the circulating movement direction of the chain 11. Thus, the rotational moment as indicated by the arrowed line DT in FIG. 6 is less likely to occur in the cutter bit plates 50M. This makes it possible to reduce a shear force to be applied to the shoe bolt S1 to thereby suppress occurrence of loosening, disengagement, breakage or the like of the shoe bolt S1.

(2) Although the above embodiment has been described based on an example where each of the first cutter bit plates 50A is devoid of the central convex portion 502 and the lateral convex portions 503 as in the second cutter bit plates 50B, the present invention is not limited thereto. For example, each of the first cutter bit plates 50A may be configured to include the central convex portion 502 and the lateral convex portions 503, to thereby reduce rotational moments to be applied to the first cutter bit plate 50A.

According to a first aspect of the present invention, there is provided an excavating apparatus for forming a continuous trench below a ground surface. The excavating apparatus comprises: an apparatus body disposed on the ground surface; a support member suspended from the apparatus body and disposed below the ground surface; an endless-shaped chain supported by the support member in such a manner as to be movable on an outer periphery of the support member along a given circulating movement plane in a given circulating movement direction; a plurality of excavation blade plates fixed to an outer peripheral surface of the chain at intervals along the circulating movement direction of the chain, wherein each of the excavation blade plates includes: a plate body extending longer than the chain along a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, wherein the excavation blade plates is circulatingly movable integrally together with the chain to thereby excavate the ground; a plurality of fastening members fastening the chain and the excavation blade plates together along a direction parallel to the circulating movement plane and orthogonal to the width direction, in such a manner that the outer peripheral surface of the chain and the reverse surface of the plate body come into press contact with each other; a chain drive section which circulatingly moves the chain along the circulating movement direction; and a support member drive section which moves the support member along a given forward movement direction, wherein the chain includes: a pair of strip members each formed in an endless shape and disposed with a distance therebetween in the width direction, wherein each of the pair of strip members has the outer peripheral surface; and a coupling member coupling the pair of strip members together in such a manner as to enable the distance between the pair of strip members to be kept constant, and each of the excavation blade plates includes an inward-side protruding portion formed to protrude from the reverse surface of the plate body and inserted into a space between the pair of strip members, wherein the inward-side protruding portion has a pair of outer side surfaces each being in surface contact with a respective one of inner side surfaces of the pair of strip members extending along the circulating movement direction.

In the excavating apparatus according the first aspect of the present invention, even in a situation where, during excavation of the ground, a moment causing the excavation blade plate to be rotated in a plane parallel to the plate body due to reaction forces received from the ground by the excavation blades is likely to be generated, the rotation of the excavation blade plate is restrained by contact between corresponding ones of the outer side surfaces of the inward-side protruding portion and the inner side surfaces of the pair of strip members. This makes it possible to reduce a shear force to be applied to the fastening member which fixes the excavation blade plate. As a result, it becomes possible to suppress loosening, disengagement, breakage or the like of the fastening member.

Preferably, in the excavating apparatus according the first aspect of the present invention, each of the excavation blade plates further includes a pair of outward-side protruding portions each formed to protrude from the reverse surface of the plate body in such a manner as to clamp a respective one of the pair of strip members in the width direction in cooperation with the inward-side protruding portion, wherein each of the pair of outward-side protruding portions has an inner side surface being in surface contact with an outer side surface of a corresponding one of the pair of strip members extending along the circulating movement direction.

According to this feature, it becomes possible to further restrain the rotation of each of the excavation blade plates by means of the contact between corresponding ones of the inner side surfaces of the outward-side protruding portions and the outer side surfaces of the pair of strip members. This makes it possible to further suppress loosening, disengagement, breakage or the like of the fastening member.

Preferably, the excavating apparatus according the first aspect of the present invention satisfies the following relationship: $L \geq d \times 2.5$, where: d denotes a width of the support member in the width direction; and L denotes a distance in the width direction between the excavation blades disposed at the opposite ends of the excavation blade plate.

According to this feature, even in a case where it is necessary to excavate a relatively wide region below the ground surface, it becomes possible to reduce a shear force to be applied to the fastening member, while stably performing the circulating movement of the chain and the forward movement of the support member.

According to a second aspect of the present invention, there is provided an excavation blade plate which is fixed to an outer peripheral surface of an endless-shaped chain supported by a given support member in such a manner as to be movable on an outer periphery of the support member along a given circulating movement plane in a given circulating movement direction, wherein the chain includes a pair of strip members each formed in an endless shape and disposed with a distance therebetween in a given width direction thereof, and a coupling member coupling the pair of strip members together in such a manner as to enable the distance between the pair of strip members to be kept constant. The excavation blade plate comprising: a plate body extending longer than the chain along the width direction of the chain orthogonal to each of the circulating movement plane of the chain and the circulating movement direction of the chain, and having an obverse surface and a reverse surface; a plurality of excavation blades arranged on the obverse surface of the plate body at least at opposite ends thereof in the width direction, in opposed relation to a ground below a ground surface; and an inward-side protruding portion formed to protrude from the reverse surface of the plate body and inserted into a space between the pair of strip members, wherein the inward-side protruding portion has a pair of outer side surfaces each being in surface contact with a respective one of inner side surfaces of the pair of strip members extending along the circulating movement direction, wherein the excavation blade plate is fastened to the chain by a plurality of fastening members, along a direction parallel to the circulating movement plane and orthogonal to the width direction, in such a manner that the outer peripheral surface of the chain and the reverse surface of the plate body come into press contact with each other.

In the excavation blade plate according the second aspect of the present invention, it becomes possible to reduce a shear force to be applied to the fastening member which fixes the excavation blade plate. This makes it possible to suppress loosening, disengagement, breakage or the like of the fastening member.

The excavation blade plate according to the second aspect of the present invention may further comprise a pair of outward-side protruding portions each formed to protrude from the reverse surface of the plate body in such a manner as to clamp a respective one of the pair of strip members in the width direction in cooperation with the inward-side protruding portion, wherein each of the pair of outward-side protruding portions has an inner side surface being in surface contact with an outer side surface of a corresponding one of the pair of strip members extending along the circulating movement direction.

According to this feature, it becomes possible to further reduce the shear force to be applied to the fastening member which fixes the excavation blade plate. This makes it possible to further suppress the loosening, disengagement, breakage or the like of the fastening member.

According to a third aspect of the present invention, there is provided an excavating method for forming a continuous trench below a ground surface by circulatingly moving an endless-shaped chain and a plurality of excavation blade plates integrally around a given support member, wherein: the chain includes a pair of strip members each formed in an endless shape and disposed with a distance therebetween in a given width direction, and a coupling member coupling the pair of strip members together in such a manner as to enable the distance between the pair of strip members to be kept constant, wherein the chain is movable along a given circulating movement plane orthogonal to the width direction, in a given circulating movement direction; and the plurality of excavation blade plates are fixed to an outer peripheral surface of the chain at intervals along the circulating movement direction of the chain, wherein each of the excavation blade plates includes: a plate body having an obverse surface and a reverse surface; and a plurality of excavation blades arranged on the obverse surface of the plate body at least at opposite ends thereof, in opposed relation to a ground below the ground surface. The excavating method comprises: a preparation step of fittingly attaching each of the excavation blade plates to the chain such that an inward-side protruding portion protruding from the reverse surface of the plate body of the excavation blade plate is inserted into a space between the pair of strip members, wherein each of a pair of outer side surfaces of the inward-side protruding portion extending along the circulating movement direction is brought into surface contact with a respective one of inner side surfaces of the pair of strip members extending along the circulating movement direction, and fastening, by a plurality of fastening members, the chain and the excavation blade plates together along a direction parallel to the circulating movement plane and orthogonal to the width direction, in such a manner that outer peripheral surfaces of the pair of strip members and the reverse surface of the plate body of each of the excavation blade plates are brought into press contact with each other; and an excavation step of circulatingly moving the chain around the support member and moving the support member along a given forward movement direction to excavate the ground by the excavation blades, while restraining each of the excavation blade plates from being rotated in a plane parallel to the plate body due to reaction forces applied from the ground to the excavation blades, by means of the contact between corresponding ones of the outer side surfaces of the inward-side protruding portion and the inner side surfaces of the pair of strip members.

In the excavation method according to the third aspect of the present invention, it becomes possible to enable excavation operation to be performed while maintaining a reduced shear force to be applied to the fastening member which fixes the excavation blade plate, during excavation of the ground.

In the excavating method according to the third aspect of the present invention, the preparation step may include: providing a pair of outward-side protruding portions formed to protrude from the reverse surface of the plate body, on both sides of and spaced-apart relation to the inward-side protruding portion in the width direction; fittingly attaching each of the excavation blade plates to the chain such that each of the pair of outward-side protruding portions clamps a respective one of the pair of strip members in the width direction in cooperation with the inward-side protruding portion, wherein an inner side surface of each of the pair of outward-side protruding portions extending along the circulating movement direction is brought into surface contact with an outer side surface of a corresponding one of the pair of strip members extending along the circulating movement direction; and fastening, by a plurality of fastening members, the chain and the excavation blade plate together, wherein the excavation step may include: excavating the ground by the excavation blades, while further restraining each of the excavation blade plates from being rotated in the plane parallel to the plate body due to the reaction forces applied from the ground to the excavation blades, by means of the contact between corresponding ones of the inner side surfaces of the pair of outward-side protruding portions and the outer side surfaces of the pair of strip members.

According to this feature, it becomes possible to enable the excavation operation to be performed while maintaining a further reduced shear force to be applied to the fastening member which fixes the excavation blade plate, during excavation of the ground.

In the excavating method according to the third aspect of the present invention, respective widths of the support member and the plate body and an arrangement of the excavation blades may be set to satisfy the following relationship: $L \geq d \times 2.5$, where: d denotes a width of the support member in the width direction; and L denotes a distance in the width direction between the excavation blades disposed at the opposite ends of the excavation blade plate.

According to this feature, even in the case where it is necessary to excavate a relatively wide region below the ground surface, it becomes possible to enable the excavation operation to be performed while maintaining a reduced shear force to be applied to the fastening member.

This application is based on Japanese Patent application No. 2016-195949 filed in Japan Patent Office on Oct. 3, 2016, the contents of which are hereby incorporated by reference. Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An excavating apparatus for forming a continuous trench below a ground surface, comprising:

an apparatus body disposed on the ground surface;

a support member suspended from the apparatus body and disposed below the ground surface;

an endless-shaped chain supported by the support member in such a manner as to be movable on an outer periphery of the support member in a given circulating movement plane in a given circulating movement direction;

a plurality of excavation blade plates fixed to an outer peripheral surface of the chain at intervals along the circulating movement direction of the chain, each of the excavation blade plates including: a plate body extending longer than the chain in a width direction of the chain orthogonal to each of the circulating movement plane of the chain and the circulating movement direction of the chain, and having an obverse surface and a reverse surface; and a plurality of excavation blades arranged on the obverse surface of the plate body at least at opposite ends thereof in the width direction, in opposed relation to a ground below the ground surface, the excavation blade plates being circulatingly movable integrally together with the chain to thereby excavate the ground;

a plurality of fastening members fastening the chain and the excavation blade plates together in a direction parallel to the circulating movement plane and orthogonal to the width direction, in such a manner that the outer peripheral surface of the chain and the reverse surface of the plate body come into press contact with each other;

a chain drive section which circulatingly moves the chain in the circulating movement direction; and a support member drive section which moves the support member along a given forward movement direction, wherein the chain includes:

a pair of strip members each formed in an endless shape and disposed with a distance therebetween in the width direction, each of the pair of strip members having the outer peripheral surface; and a coupling member coupling the pair of strip members together in such a manner as to enable the distance between the pair of strip members to be kept constant, and each of the excavation blade plates includes an inward-side protruding portion formed to protrude from the reverse surface of the plate body and inserted into a space between the pair of strip members, the inward-side protruding portion having a pair of outer side surfaces each being in surface contact with a respective one of inner side surfaces of the pair of strip members extending in the circulating movement direction.

2. The excavating apparatus as recited in claim 1, wherein each of the excavation blade plates further includes a pair of outward-side protruding portions each formed to protrude from the reverse surface of the plate body in such a manner as to clamp a respective one of the pair of strip members in the width direction in cooperation with the inward-side protruding portion, each of the pair of outward-side protruding portions having an inner side surface being in surface contact with an outer side surface of the pair of strip members extending in the circulating movement direction.

3. The excavating apparatus as recited in claim 1, which satisfies the following relationship: $L \geq d \times 2.5$, where: d denotes a width of the support member in the width direction; and L denotes a distance in the width direction between the excavation blades disposed at the opposite ends of the excavation blade plate.

4. An excavation blade plate which is fixed to an outer peripheral surface of an endless-shaped chain supported by a given support member in such a manner as to be movable on an outer periphery of the support member in a given circulating movement plane in a given circulating movement direction, wherein the chain includes a pair of strip members each formed in an endless shape and disposed with a distance therebetween in a given width direction, and a coupling member coupling the pair of strip members together in such a manner as to enable the distance between the pair of strip members to be kept constant, the excavation blade plate comprising:

a plate body extending longer than the chain in the width direction of the chain orthogonal to each of the circulating movement plane of the chain and the circulating movement direction of the chain, and having an obverse surface and a reverse surface;

a plurality of excavation blades arranged on the obverse surface of the plate body at least at opposite ends thereof in the width direction, in opposed relation to a ground below a ground surface; and an inward-side protruding portion formed to protrude from the reverse surface of the plate body and inserted into a space between the pair of strip members, the inward-side protruding portion having a pair of outer side surfaces each being in surface contact with the inner side surfaces of the pair of strip members extending in the circulating movement direction, wherein the excavation blade plate is fastened to the chain by a plurality of fastening members, in a direction parallel to the circulating movement plane and orthogonal to the width direction, in such a manner that the outer peripheral surface of the chain and the reverse surface of the plate body come into press contact with each other.

5. The excavation blade plate as recited in claim 4, further comprising a pair of outward-side protruding portions each formed to protrude from the reverse surface of the plate body in such a manner as to clamp a pair of strip members in the width direction in cooperation with the inward-side protruding portion, each of the pair of outward-side protruding portions having an inner side surface being in surface contact with an outer side surface of the pair of strip members extending in the circulating movement direction.

6. An excavating method for forming a continuous trench below a ground surface by circulatingly moving an endless-shaped chain and a plurality of excavation blade plates integrally around a given support member, wherein: the chain includes a pair of strip members each formed in an endless shape and disposed with a distance therebetween in a given width direction, and a coupling member coupling the pair of strip members together in such a manner as to enable the distance between the pair of strip members to be kept constant, the chain being movable in a given circulating movement plane orthogonal to the width direction, in a given circulating movement direction; and the plurality of excavation blade plates are fixed to an outer peripheral surface of the chain at intervals in the circulating movement direction of the chain, each of the excavation blade plates including: a plate body having an obverse surface and a reverse surface; and a plurality of excavation blades arranged on the obverse surface of the plate body at least at opposite ends thereof, in opposed relation to a ground below the ground surface, the excavating method comprising:

a preparation step of fittingly attaching each of the excavation blade plates to the chain such that an inward-side protruding portion protruding from the reverse surface of the plate body of the excavation blade plate is inserted into a space between the pair of strip members, wherein each of a pair of outer side surfaces of the inward-side protruding portion extending in the circulating movement direction is brought into surface contact with an inner side surfaces of the pair of strip members extending in the circulating movement direction, and fastening, by a plurality of fastening members, the chain and the excavation blade plates together in a direction parallel to the circulating movement plane and orthogonal to the width direction, in such a manner that outer peripheral surfaces of the pair of strip members and the reverse surface of the plate body of each of the excavation blade plates are brought into press contact with each other; and an excavation step of circulatingly moving the chain around the support member and moving the support member in a given forward movement direction to excavate the ground by the excavation blades, while restraining each of the excavation blade plates from being rotated in a plane parallel to the plate body due to reaction forces applied from the ground to the excavation blades, by means of the contact between the outer side surfaces of the inward-side protruding portion and the inner side surfaces of the pair of strip members.

7. The excavating method as recited in claim 6, wherein the preparation step includes: providing a pair of outward-side protruding portions formed to protrude from the reverse surface of the plate body, on both sides of and spaced-apart relation to the inward-side protruding portion in the width direction; fittingly attaching each of the excavation blade plates to the chain such that each of the pair of outward-side protruding portions clamps the pair of strip members in the width direction in cooperation with the inward-side protruding portion, wherein an inner side surface of each of the pair of outward-side protruding portions extending in the circulating movement direction is brought into surface contact with an outer side surface of a corresponding one of the pair of strip members extending in the circulating movement direction; and fastening, by a plurality of fastening members, the chain and the excavation blade plate together, and wherein the excavation step includes: excavating the ground by the excavation blades, while further restraining each of the excavation blade plates from being rotated in the plane parallel to the plate body due to the reaction forces applied from the ground to the excavation blades, by means of the contact between corresponding ones of the inner side surfaces of the pair of outward-side protruding portions and the outer side surfaces of the pair of strip members.

8. The excavating method as recited in claim 6, wherein respective widths of the support member and the plate body and an arrangement of the excavation blades are set to satisfy the following relationship: $L \geq d \times 2.5$, where: d denotes a width of the support member in the width direction; and L denotes a distance in the width direction between the excavation blades disposed at the opposite ends of the excavation blade plate.

* * * * *